United States Patent [19]

Gonzalez

[11] Patent Number: 4,957,257

[45] Date of Patent: Sep. 18, 1990

[54] COMPOUND CLAMP WITH ADJUSTABLE PERPENDICULAR CLAMPING COMPONENT

[76] Inventor: Luis M. Gonzalez, 8710 E. Gregory La., Des Plaines, Ill. 60016

[21] Appl. No.: 412,857

[22] Filed: Sep. 28, 1989

[51] Int. Cl.[5] ..... A47G 29/02

[52] U.S. Cl. ..... 248/231.7; 248/410; 269/156; 269/167

[58] Field of Search ..... 248/231.7, 410, 316.1; 269/170, 156, 171.5, 142, 143, 249, 167; 24/486, 525

[56] References Cited

U.S. PATENT DOCUMENTS

| | | | |
|---|---|---|---|
| 359,833 | 3/1887 | Basinger | 269/249 X |
| 1,402,621 | 1/1922 | Kesslering | 269/171.5 X |
| 1,788,546 | 1/1931 | Schmieder | 269/156 X |
| 2,148,307 | 2/1939 | Scott | 248/231.7 |
| 2,541,605 | 2/1951 | Ohlsson | 269/156 X |
| 2,610,661 | 9/1952 | Romine | 269/156 |
| 2,627,113 | 2/1953 | Moray | 269/249 X |
| 2,642,905 | 6/1953 | Hewat | 269/156 X |
| 2,675,839 | 4/1954 | Beasley | 269/249 X |
| 2,815,778 | 12/1957 | Holman | 269/170 |
| 2,947,333 | 8/1960 | Johnson | 269/170 |

*Primary Examiner*—David M. Purol

*Attorney, Agent, or Firm*—Wallenstein, Wagner & Hattis, Ltd.

[57] ABSTRACT

A compound clamp comprises a first clamping component defining a plane and having a clamping arrangement presenting a force along a first clamping axis in that plane and a second clamping component having a second clamping axis, the second clamping axis being perpendicular to the second clamping axis. The clamp also includes a further arrangement for attaching the second clamping component to the first clamping component so that the second clamping axis is in the plane of the first clamping component and is translationally adjustable along the first clamping axis independent of the clamping arrangement of the first clamping component.

6 Claims, 1 Drawing Sheet

10
12
13
14
16
18
20
22
24
26
28
30
32
33
34
35
38
40
42
50
52
54
A
B
C
X
Y
Y1
S
T
"1"

COMPOUND CLAMP WITH ADJUSTABLE PERPENDICULAR CLAMPING COMPONENT

TECHNICAL FIELD

The present invention relates to clamps having perpendicular clamping components and particularly to such clamps having one clamping component translationally adjustable along an axis of the other clamping component.

BACKGROUND OF THE INVENTION

Compound clamps having perpendicular first and second clamping components are useful in carpentry. Therefore, compound clamps have been provided with perpendicular first and second clamping components. The first clamping component applies a force along a first clamping axis to securely hold one or more work pieces together. The second clamping component applies a force along a second clamping axis perpendicular to the first clamping axis to secure an additional work piece to the first work piece(s). Examples of such clamps are disclosed in U.S. Pat. No. 242,959 to Naglee and U.S. Pat. No. 1,402,621 to Knittel and Kesslering.

Compound clamps are particularly useful in the fabrication of countertops. For example, in fabricating a length of countertop, typically a single finished sheet is adhered to a countertop frame to cover its upper surface. It is advantageous to adhere a finished edge strip or facing to the countertop frame at the same time. Thus, a first clamping component may be used to secure a finished surface sheet to a countertop frame while the perpendicular clamping component is used to secure a finished edge strip to the countertop frame. In such a use, it is necessary for the second clamping component to be translationally adjustable along the first clamping axis so that the second clamping force may be applied to the appropriate area depending on the relative size, shape and desired position of the various work pieces.

A problem exists with the clamps disclosed in the above patents. The first clamping component of each of these clamps includes two opposed coaxial clamping screws which provide a force for clamping in a first clamping axis. Translational adjustability of the second clamping component along the first clamping axis can only be achieved by reciprocal adjustment of the two clamping screws. Adjustment in this manner is undesirable because threading is a relatively slow process especially since both clamping screws must be turned separately and in a reciprocal fashion.

This is particularly a problem in the fabrication of countertops because the large surface area to be clamped typically requires many clamps to secure the finished sheets until the adhesives set. Typically adhesives used to bond the sheets to the countertop frames become tacky very rapidly and can prevent realignment of the finished surfaces after a short time. Therefore, time spent in adjusting each clamp is critical.

Other solutions have been proposed to solve this problem with some degree of success. For example, U.S. Pat. No. 2,642,905 to Hewat and U.S. Pat. No. 1,788,546 to Schmieder disclose clamps which provide for a second clamping component which is perpendicular to a first clamping component and is translationally adjustable along an axis thereof. However, a problem exists in the clamps disclosed by both Hewat and Schmieder.

For example, the clamp disclosed by Hewat includes a frame member having a slot disposed through a longitudinal portion thereof. The second clamping component includes a threaded clamping screw carried in a generally cylindrical support member which is made adjustable along the support frame by means of a pin extending from one side of the support member through the slot and slidable therein. Thus, the clamping screw of the second clamping component is mounted to the side of the frame. This configuration results in clamping force being directed along a clamping axis which is beside the frame and out of a plane defined by the first clamping component. This causes a moment or torque about the frame which can cause the entire clamp to twist. Once the clamp twists, the second clamping component is directed at an angle to the work piece.

The device of Schmieder suffers from the same problem because its similar configuration provides that a perpendicular clamping screw is mounted to the side of a frame or standard. The twisting of these clamps is particularly a problem where finished sheets are adhesively bonded to a countertop frame. When the clamp twists, the finish sheets will tend to slide on the adhesive. This is particularly true of any edge or face strips engaged by the second clamping component because the second clamping component becomes angled with respect to the face strip after the clamp twists. When working with countertop materials such as CORIAN TM, adhesives used tack rapidly and set on the order of 30 to 45 minutes. Thus, any sliding of the work pieces can cause disastrous results as they may become permanently adhered to the work piece in an incorrect position.

The present invention provides a solution to this problem as well as providing a quick and easy to use clamp for general work and particularly, the fabrication of countertops.

SUMMARY OF THE INVENTION

The clamp of the present invention provides perpendicular first and second clamping components. The first clamping component defines a plane and has clamping means for presenting a clamping force along a first clamping axis in the plane. The second clamping component has a second clamping axis, the second clamping axis being perpendicular to the first clamping axis. Means are provided for attaching the second clamping component to the first clamping component so that the second clamping axis is in the plane of the first clamping component and is translationally adjustable along the first clamping axis independent of the clamping means of the first clamping component.

Preferably the first clamping component of the clamp includes a first arm, a second arm and a support frame connecting the first and second arms; all of which are generally aligned in a plane. The support frame includes first and second support members in spaced parallel relation. A first clamp means is operatively associated with the first arm for presenting a clamping force along a first clamping axis to secure one or more work pieces between the first and second arms.

Preferably the second clamping component of the clamp includes a bridge attached to both the first and second support members and a second clamp means attached to the bridge. The second clamp means presents a second clamping force along a second clamping axis, perpendicular to the first clamping axis, for securing a second work piece to the first work piece.

The bridge is positionable along the support frame between the first and second arms. The second clamp means is attached to the bridge so that the second clamping axis is generally centered between the first and second members of the support frame so that any reaction forces will be shared equally by both support members. Thus, the second clamping force will not produce a torque in the clamp. This prevents twisting of the clamp.

According to another aspect of the invention, an end portion of the lower arm is extendable in the first clamping axis. This extendability provides for clamping in the first axis even when the second work piece, such as a countertop edge, depends from the first work piece so as to obstruct a conventional clamp.

Other advantages and aspects of the invention will become apparent upon making reference to the specification, claims, and drawings to follow.

DETAILED DESCRIPTION OF THE INVENTION

Figures 1, 2, 3:
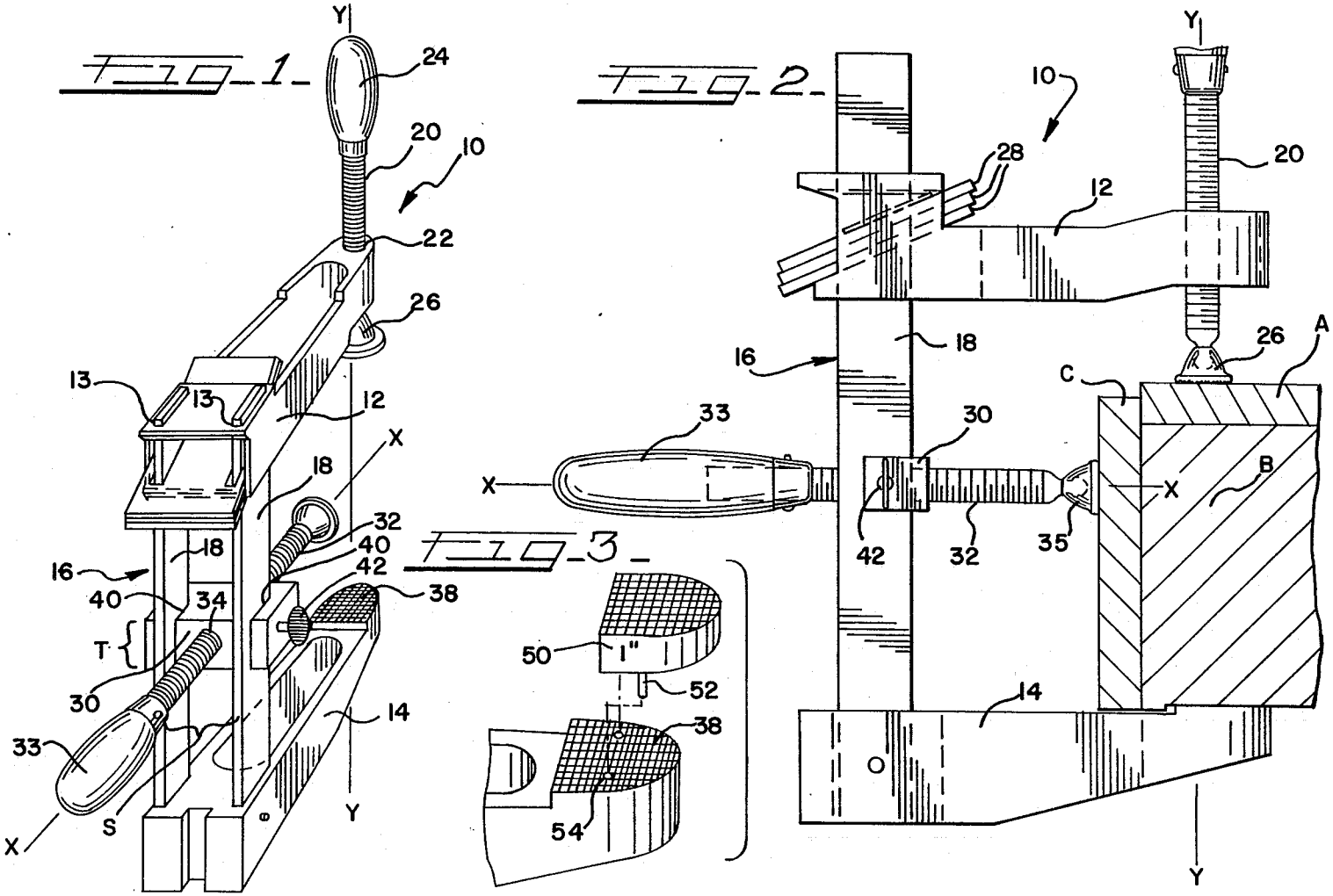
FIG. 1 is a perspective view of the compound clamp of the present invention.
FIG. 2 is a right side view of the compound clamp.
FIG. 3 is an perspective exploded view of an end portion of the lower arm showing a work engaging extension of the clamp.

While this invention is susceptible of embodiment in many different forms, there is shown in the drawings and will herein be described in detail a preferred embodiment of the invention. The present disclosure is to be considered as an exemplification of the principles of the invention and is not intended to limit the broad aspect of the invention to embodiment illustrated.

FIG. 1 discloses the compound clamp 10 of the present invention including perpendicular first and second clamping components.

The first clamping component of clamp 10 generally comprises, a support frame 16, a first arm 12, a second arm 14 and a clamping screw 20. The first clamping arm 12 and the second clamping arm 14 are connected by the support frame 16. As can be seen in FIG. 1, the first clamping component is aligned in a plane defined by the intersecting lines X—X and Y—Y.

Support frame 16 includes two parallel spaced support members 18, preferably in the form of rectangular bars. The clamping screw 20 is threadedly disposed through a threaded aperture 22 at one end of the first arm 12. An upper portion of the clamping screw 20 provides a handle 24 for turning the clamping screw 20. The opposite end of the clamping screw 20 provides a universally adjustable work engaging foot 26.

In a preferred embodiment of the clamp 10, the first arm 12 is slidably adjustable along the support frame 16 while arm 14 is fixed at one end of the support frame 16. Positional adjustment of the first arm 12 is accomplished by conventional means such as slots 13 and a plurality of superimposed canted keys 28. A further description of the operation of such a mechanism is disclosed in U.S. Pat. No. 2,815,778 which is incorporated by reference herein.

Clamping force in the first clamping component is provided by the clamping screw 20 along a first clamping axis indicated by the line Y—Y in FIG. 2. Thus, the first clamping component may be used to secure a work piece A to a work piece B, as shown in FIG. 2.

The second clamping component of the clamp 10 generally includes a bridge 30 and a clamping screw 32. The bridge 30 is movably attached to both support members 18 of the support frame. The clamping screw 32 is disposed through a cooperably threaded aperture 34 at the center of the bridge 30. The opposite end of the clamping screw provides a universally adjustable work engaging foot 35. An upper portion of the clamping screw 32 provides a handle 33 for turning the clamping screw 32.

As best disclosed in FIG. 2, the first clamping component secures work pieces A to B, while the second clamping component can be used to secure a third work piece C to the first work pieces A and B. The clamping force of the second clamping component is provided by clamping screw 32 along the second clamping axis indicated by line X—X of FIG. 2. The second clamping axis is perpendicular to the first clamping axis indicated by line Y—Y.

According to a primary aspect of the invention, the second clamping component is in the plane (X—X, Y—Y) of the first clamping component with the second clamping axis centered with respect to the support frame 16. This configuration provides that no torque due to the second clamping component is developed in the clamp 10. At the same time, the second clamping component is translationally adjustable along the first clamping axis without adjustment of the first clamping screw 20.

In the preferred embodiment disclosed, this is accomplished by disposing the screw clamp 32 between the support members 18. Thus, any forces transmitted through the clamping screw 32 are shared equally by the first and second support members 18. At the same time, the second clamping axis is translationally adjustable along the first clamping axis by repositioning of the bridge 30 along the support frame 16.

A preferred means of movably attaching the bridge 30 includes slots 40 at opposed ends of the bridge 30 which are adapted to slidably engage the support members 18. The slots 40 engage the support members 18 on a side of the support members 18 which will face the work pieces so that response forces directed back along the clamping screw 32 will tend to secure the attachment of the bridge 30 to the support members 18. The opposite effect would obtain if the slots 40 engaged a side of the support members facing away from the work pieces. A thumb screw 42 is threaded through one end of the bridge 30 so that an end of the thumb screw 42 can engage a support member 18 to lock the bridge 30 into a position once properly adjusted.

It will be noted that it is desirable, particularly in the fabrication of countertops, to first use the first clamping component to secure a top finish sheet to a frame (such as C to B in FIG. 2) before adding the edge or facing strip (such as C in FIG. 2). When adding the facing strip, it is desirable to have as much working space between the first work pieces (such as A, B in FIG. 2) and the support frame 16 as is possible. Therefore, it is desirable not to have the second clamping component attached to the first clamping component until the facing strip has been added.

Therefore, according to another aspect of the invention, at least a thickness T of the bridge 30 is less than the width of the space S between the support members 18 so that the bridge 30 and clamping screw 32 can be attached to the clamp 10 even after the first clamping component is engaged on a work piece. To add the second clamping component to the clamp 10, the user need only orient the bridge 30 in such a way as to pass its thickness T through the support members 18 then turn the bridge 30, 90 degrees and engage the slots 40 around the support members 18 in the appropriate position then tighten the thumb screw 42.

According to another aspect of the invention, the second arm 14 includes a surface 38 at its free end to engage a work piece. The surface is cross hatched so as to better grip a work piece.

It should be noted that it is sometimes desirable to fabricate a structure where a work piece such as C in FIG. 2 will depend lower than a bottommost surface of the first work piece, such as B in FIG. 2. With conventional clamps, a block of wood or other material would be interposed between the work piece B and the surface 38 to enable clamping in the first clamping axis. This is an undesirable procedure because the block of wood would have to be balanced on the work engaging surface 38 until the clamp was tightened on the work surface. Furthermore, such blocks are not usually uniform or readily at hand.

Therefore, according to another aspect of the invention, as best disclosed in FIG. 3, an extension block 50 is provided when, for example, a work piece such as C of FIG. 2, is required to be positioned so that it depends well below the work piece B. In such a case, the extension block 50 is attached to the work surface 38 to span the distance and engage the work piece B without disturbing the work piece C. The extension 50 is preferably attached to work surface 38 by inserting pins 52, which extend from a surface of the extension block 50, into mating apertures 54 located in the work surface 38 of arm 14. This method of attachment is relatively quick which as noted above becomes very crucial when clamps are used to secure work pieces that are glued together. The invention envisions the provision of a series of extension blocks 50 with varying extension heights with the height indicated on the extension block. For example, the extension block 50 illustrated in FIG. 3 is marked with a 1" (inch) mark.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

I claim:

1. A clamp comprising:

a first clamping component defining a plane and having first clamping means for presenting a clamping force along a first clamping axis in the plane, said first clamping means including a first arm and a second arm defining a plane, and means for moving said first arm relative to said second arm within said plane;

a second clamping component having a second clamping axis, the second clamping axis being perpendicular to the first clamping axis; and, means for attaching the second clamping component to the first clamping component so that the second clamping axis is in the plane of the first clamping component and is translationally adjustable along the first clamping axis independent of the clamping means of the first clamping component.

2. A clamp comprising:

(a) a first arm;

(b) a second arm;

(c) a support frame connecting the first arm and the second arm, the support frame including a first support member and a second support member, the first and second support members being in spaced parallel relation, the first arm, second arm and the support frame being generally aligned in a plane;

(d) a first clamp means, operatively associated with the first arm, for presenting a clamping force along a first clamping axis;

(e) a bridge with opposed ends, the bridge being movably attached to both the first and second support members of the support frame and selectively positionable thereby along the support frame between the first and second arms, said bridge including means for locking said bridge in said selected position; and, (f) a second clamp means attached to the bridge for presenting a second clamping force along a second clamping axis, the second clamping axis being perpendicular to the first clamping axis, the second clamp means being located on the bridge so that the second clamping axis is in the plane.

3. The clamp of claim 2, wherein the first arm is positionably adjustable on the support frame.

4. The clamp of claim 2 wherein:

(a) the first and second support members are generally rectangular having length, width and thickness dimensions and being oriented with a width dimension of the support members facing each other;

(b) the bridge being generally rectangular having a length between the opposed ends, a width and thickness;

(c) means defining a pair of slots attaching the support members to the bridge, with one slot being formed proximate to each opposed end of the bridge, each slot being dimensioned to engage around the thickness of the support members and be slidable thereon;

(d) said second clamping means including a threaded screw operatively threaded through a center of the bridge; and, (e) the support members being spaced apart to allow operation of the threaded screw therebetween.

5. The clamp of claim 4, wherein the first arm is positionably adjustable on the support frame.

6. The clamp of claim 5 wherein the thickness of the bridge is dimensioned to pass between the beams.

* * * * *